US009527076B2

(12) United States Patent
Wetzel et al.

(10) Patent No.: US 9,527,076 B2
(45) Date of Patent: Dec. 27, 2016

(54) CRUCIBLE

(71) Applicant: Leco Corporation, St. Joseph, MI (US)

(72) Inventors: Joshua N. Wetzel, Benton Harbor, MI (US); Gordon C. Ford, St. Joseph, MI (US)

(73) Assignee: Leco Corporation, St. Joseph, MI (US)

( * ) Notice: Subject to any disclaimer, the term of this patent is extended or adjusted under 35 U.S.C. 154(b) by 698 days.

(21) Appl. No.: 13/920,600

(22) Filed: Jun. 18, 2013

(65) Prior Publication Data

US 2013/0337396 A1 Dec. 19, 2013

Related U.S. Application Data

(60) Provisional application No. 61/661,603, filed on Jun. 19, 2012.

(51) Int. Cl.

| | |
|---|---|
| ***F27B 14/06*** | (2006.01) |
| ***B01L 3/04*** | (2006.01) |
| ***F27B 14/10*** | (2006.01) |

(52) U.S. Cl.

CPC ..... *B01L 3/04* (2013.01); *F27B 14/06* (2013.01); *F27B 14/10* (2013.01); *B01L 2300/0851* (2013.01); *B01L 2300/12* (2013.01)

(58) Field of Classification Search

CPC ..... F27B 14/06; F27B 14/10

USPC ..... 432/265

See application file for complete search history.

(56) References Cited

U.S. PATENT DOCUMENTS

| | | | | |
|---|---|---|---|---|
| 3,636,229 | A * | 1/1972 | Sitek | B01L 3/04 373/118 |
| 3,751,965 | A * | 8/1973 | Kraus | B01L 3/04 219/427 |
| 3,899,627 | A * | 8/1975 | Sitek | B01L 3/04 219/427 |
| 3,936,587 | A | 2/1976 | Sitek et al. | |
| 4,056,677 | A | 11/1977 | Berk et al. | |
| 4,328,386 | A * | 5/1982 | Bredeweg | B01L 3/04 373/118 |
| 4,419,754 | A | 12/1983 | Sitek et al. | |
| 4,740,991 | A * | 4/1988 | Eaton | H05B 3/0014 373/118 |
| 6,291,802 | B1 | 9/2001 | Ford | |
| 6,562,133 | B1 * | 5/2003 | Swinehart | C30B 11/00 117/220 |
| 7,402,280 | B2 | 7/2008 | Ford | |
| 2010/0089308 | A1 * | 4/2010 | Kishi | C03C 3/06 117/28 |

(Continued)

OTHER PUBLICATIONS 1 page showing five of Applicant's commercially available prior art crucibles.

*Primary Examiner* — Alissa Tompkins
*Assistant Examiner* — Nathaniel Herzfeld
(74) *Attorney, Agent, or Firm* — Price Heneveld LLP

(57) ABSTRACT

A graphite crucible has a cylindrical body with an upper opening for receiving a sample for analysis and a disk-shaped pedestal base. The pedestal base includes a bottom surface with a centrally formed circular indentation. An inwardly projecting concave arcuate annular indentation extends between the body and pedestal base with a smoothly curved radius of curvature. The upper and lower walls of the arcuate indentation diverge outwardly at an angle of from about 56° to about 60°.

4 Claims, 4 Drawing Sheets

(56) References Cited

U.S. PATENT DOCUMENTS

| | | | | |
|---|---|---|---|---|
| 2010/0319613 | A1* | 12/2010 | Fujiwara | C30B 29/06 117/28 |
| 2012/0167624 | A1* | 7/2012 | Sudo | C03B 19/095 65/17.3 |
| 2012/0213244 | A1 | 8/2012 | Latino et al. | |
| 2012/0213678 | A1 | 8/2012 | Ford | |
| 2013/0334198 | A1* | 12/2013 | Wetzel | B01L 3/04 219/426 |

* cited by examiner

CRUCIBLE

CROSS-REFERENCE TO RELATED APPLICATIONS

This application claims priority under 35 U.S.C. §119(e) and the benefit of U.S. Provisional Application No. 61/661,603 entitled CRUCIBLE, filed on Jun. 19, 2012, by Joshua N. Wetzel et al., the entire disclosure of which is incorporated herein by reference.

BACKGROUND OF THE INVENTION

The present invention relates to crucibles for fusion of a specimen and particularly to crucibles made of a resistive material.

Graphite crucibles are employed in analytical furnaces for fusing specimens to temperatures of about 2500° C. to about 3000° C. with the carbon interacting with the specimen to release gases, which are swept from the furnace area by an inert gas to detectors for subsequent determination of elements such as hydrogen, nitrogen, and oxygen. A current example of such an analytical instrument is an ONH836 furnace and analyzer available from Leco Corporation of St. Joseph, Mich. Such instruments employ a pair of electrodes, which clamp a graphite crucible therebetween and provide up to 1000 or more amps current through the graphite crucible for heating the crucible and specimen to the near 3000° C. temperature.

There have been many crucible designs employed with analytical furnaces over the years, including those described in U.S. Pat. Nos. 3,636,229, 3,899,627, and 4,328,386. Prior electrode construction for mating with such crucibles is described in U.S. Pat. Nos. 3,936,587 and 4,056,677. In order to protect the electrodes from erosion due to the high temperatures, tungsten/copper alloy tips have been employed on the upper and lower electrodes which engage the top annular rim of the crucible and the downwardly projecting pedestal, respectively, on prior art crucibles. A replaceable tip for a lower electrode is disclosed in U.S. Pat. No. 4,419,754, which discloses a removable tungsten/copper alloy tip.

Over the years, improvements have been made to such analytical furnaces, including the introduction of samples into the furnace area through a central opening in the upper electrode, such as represented by the sample drop mechanism disclosed in U.S. Pat. No. 6,291,802. Further, such instruments and furnaces have also been improved by providing automated sample loading mechanisms, such as disclosed in U.S. Pat. No. 7,402,280 and/or the use of a sample loading carousel, as disclosed in pending patent application Ser. No. 13/402,192, entitled Sample Loading Carousel, which was filed on Feb. 22, 2012, now U.S. Pat. No. 9,188,598. Also, improvements have been made in the cleaning of electrodes between analyses, such that continuous sequential analyses can be undertaken without manual cleaning of the electrodes or electrode components. One such system employed for the automated cleaning of electrodes is describe in U.S. patent application Ser. No. 13/358,096 entitled Vacuum Cleaning Structure for Electrode Furnace, which was filed on Jan. 25, 2012, now U.S. Pat. No. 9,042,425, the disclosure of which is incorporated herein by reference.

These various improvements to the earlier models of resistance furnaces have resulted in improved performance in terms of accuracy and repeatability of sample analysis. Existing furnaces, however, typically require a significant amount of power, and prior crucibles have suffered with hot spots within the crucible which tends to overheat specimens, causing their bubbling. In some cases, the molten specimens bubble out of the crucible and, in extreme cases, contaminate the upper electrode which is in contact with the open mouth of such crucibles. In order to resolve the problems with electrode wear, crucible hot spots, as well as occasional breakage of a crucible when under compression between the electrodes, an effort has been made to redesign crucibles and provide a crucible which provides even heating characteristics at the floor and lower side walls of the crucible where the specimen rests during fusion, a crucible that requires less power to reach the desired operating temperature, and a crucible which remains economically feasible to manufacture on a large scale basis.

SUMMARY OF THE INVENTION

The crucible of the present invention is designed to resolve the problems inherent with prior art crucibles, and, unexpectedly, results in a crucible when used in a resistance analytical furnace provides the same fusion temperature of about 3000° C. while requiring up to 30% less power. The crucible is made of a resistive material, such as graphite, and comprises a generally cylindrical body with an open mouth at the top and a pedestal base. An inwardly projecting concave arcuate annular indentation extends between the body and pedestal base with a smoothly curved radius of curvature. The upper and lower walls of the arcuate indentation diverge outwardly at an angle of from about 56° to about 60°. The disk-shaped pedestal base includes, in a preferred embodiment, a bottom surface with a centrally formed circular indentation. The interior floor of the cylindrical body is also concavely rounded with a first radius of curvature and the junction of the floor and the inner side walls of the cylindrical body are likewise curved at a second radius of curvature smaller than the radius of curvature of the central floor. The overall height of the crucible has been increased by about 10% over existing crucibles and, when employed in a resistance analytical furnace, provides even heating at the floor and lower sides of the cylindrical side walls of the body to achieve the desired fusion temperatures at lower power requirements. The crucible design is also robust and easily withstands the compressive force of the upper and lower electrodes during an analysis without fracturing.

These and other features, objects and advantages of the present invention will become apparent upon reading the following description thereof together with reference to the accompanying drawings.

DETAILED DESCRIPTION OF THE PREFERRED EMBODIMENT

Figure 1:
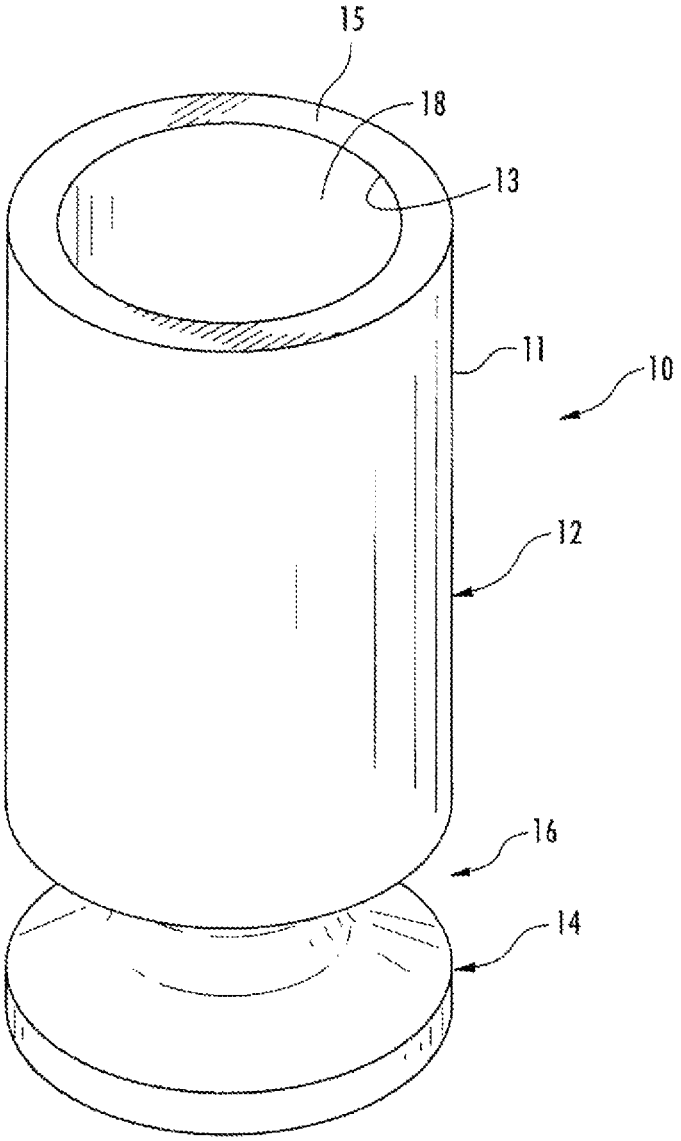
FIG. 1 is a perspective view of a crucible embodying the present invention.
Figure 4:
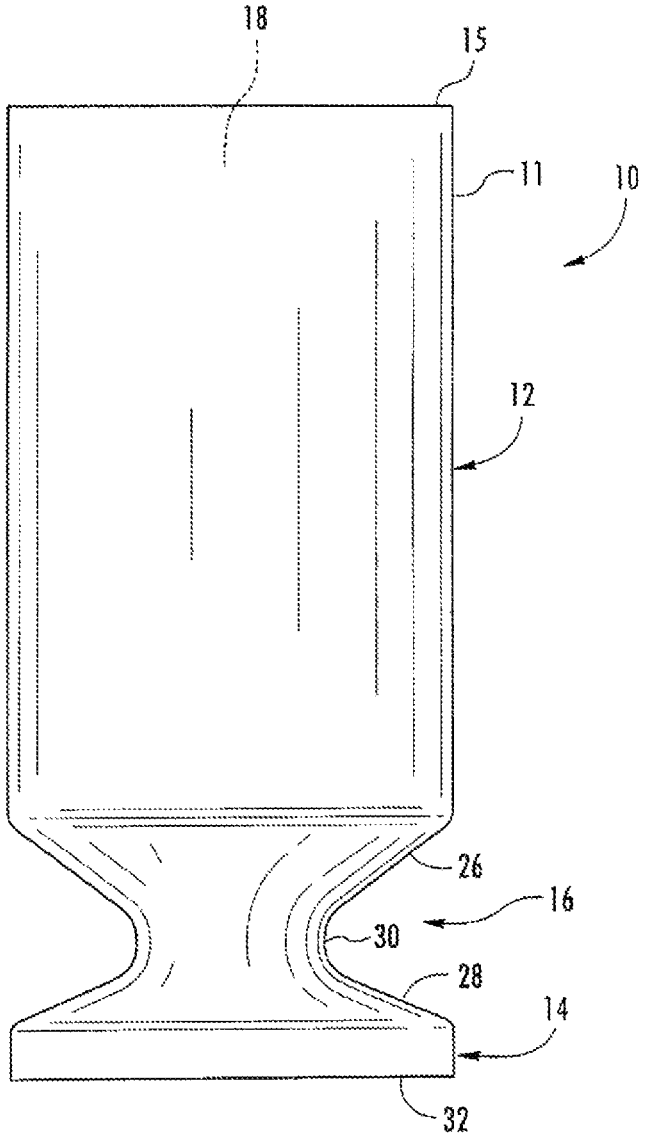
FIG. 4 is a side elevational view of the crucible shown in FIG. 1.

Referring initially to FIGS. 1 and 4, there is shown a crucible 10 embodying the present invention. Crucible 10 is made of commercial grade graphite and is machined from a solid graphite rod. The crucible has a cylindrical body 12, supported by a pedestal base 14 between which there is an annular inwardly extending concave indentation 16. The crucible has an upper opening 18 at the top for receiving specimens ranging from about 0.1 gram to 1 gram in size. The specimens can be in any form but typically are pins or chips which likewise are frequently encased in a nickel basket serving as an accelerator during the fusion process. The sample can be introduced manually in some systems or preferably by automation through an aperture in the upper electrode and a sample drop mechanism as described in the above-identified U.S. Pat. No. 6,291,802.

Figure 3:
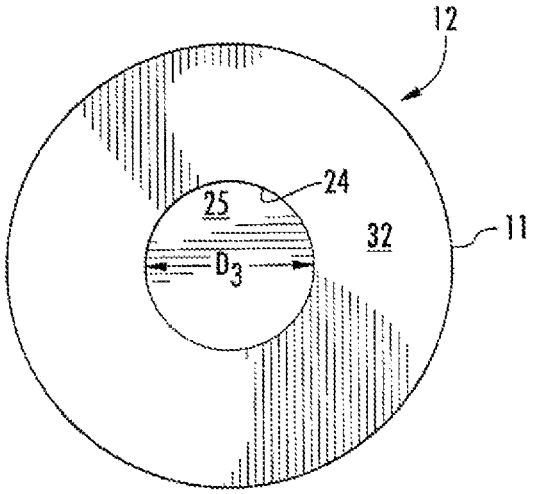
FIG. 3 is a bottom plan view of the crucible shown in FIG. 1.
Figure 5:
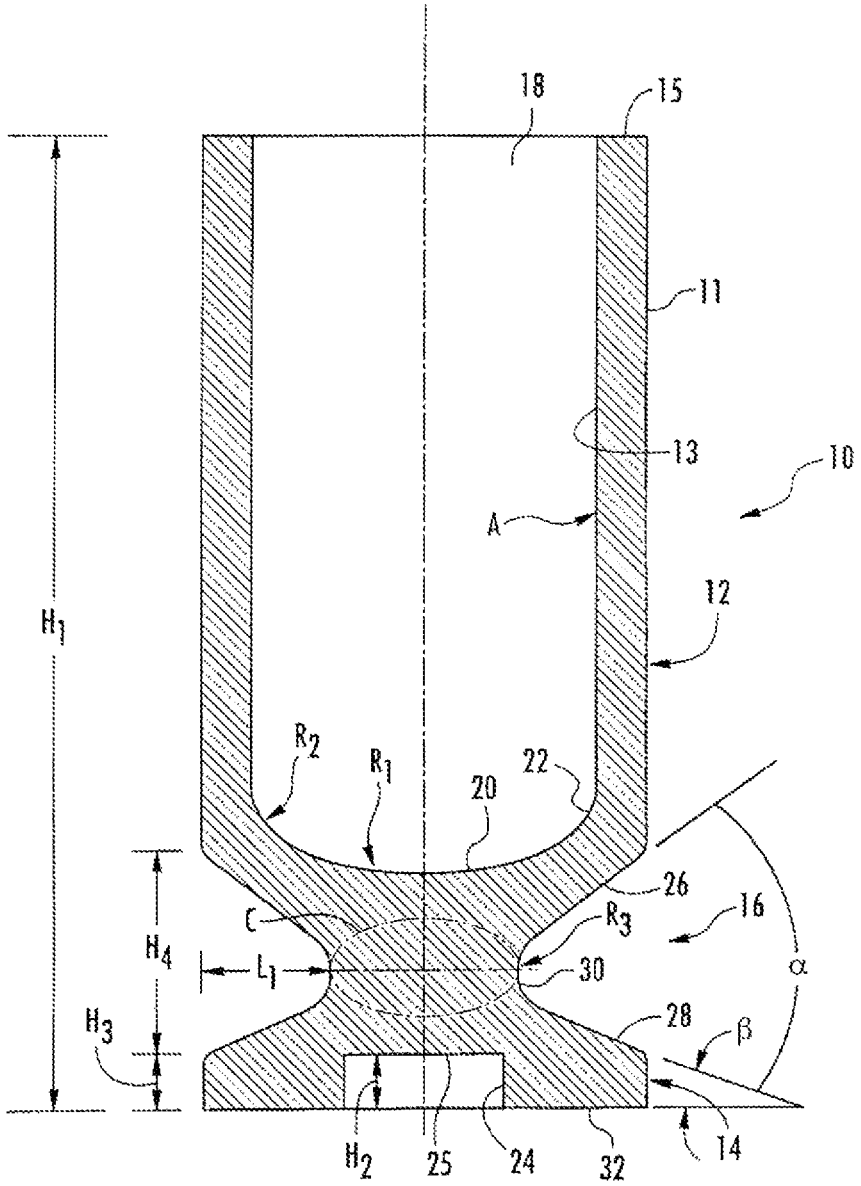
FIG. 5 is a vertical cross-sectional view of the crucible shown in FIG. 1, taken along section lines V-V in FIG. 2.

The cylindrical body 12 includes an outer cylindrical wall 11 and an inner cylindrical wall 13. As seen in FIG. 5, the interior of the crucible also includes a floor 20 which is concavely curved with a first radius of curvature $R_1$. The floor communicates with the interior side wall 13 of the cylindrical body at a curved junction 22 having a second radius of curvature $R_2$. As seen in FIGS. 3 and 5, the pedestal base has a centrally located circular indentation 24. The annular indentation 16 includes an upper wall 26 and a lower wall 28, which converge at an apex 30 having a radius of curvature $R_3$. The smoothly curved, inwardly concave annular indentation 16 has the walls 26, 28 which diverge outwardly from apex 30 at an angle $\alpha$ of from about 56° to about 60°, as illustrated in FIG. 5. The angle $\beta$ from the lower wall 28 to the floor is from 22°-24°.

The geometry of crucible 10, as best seen in FIG. 5, including the arcuate indentation 16 and circular indentation 24, results in a current choke zone circled and identified by the letter C in FIG. 5. With this design, the current flows from the annular bottom surface 32 of the pedestal, which engages the annular surface of the tip 36 on projection 21 of the lower electrode of the furnace, as described in concurrently filed U.S. patent application entitled Resistance Analytical Furnace, now US Publication No. 2013/0334198, the disclosure of which is incorporated herein by reference. The upper annular surface 15 of the crucible 10 engages the upper electrode of the furnace, such that the current passes through the crucible between surfaces 32 and 15. The geometry of the crucible with the dimensions noted below resulted in a uniform heating of the floor 20 of the crucible and the side wall 13 above the floor 20 up to the area of arrow A in FIG. 5. Unexpectedly, this geometry allowed heating of a specimen positioned in a crucible at a much lower power than is typical.

Figure 2:
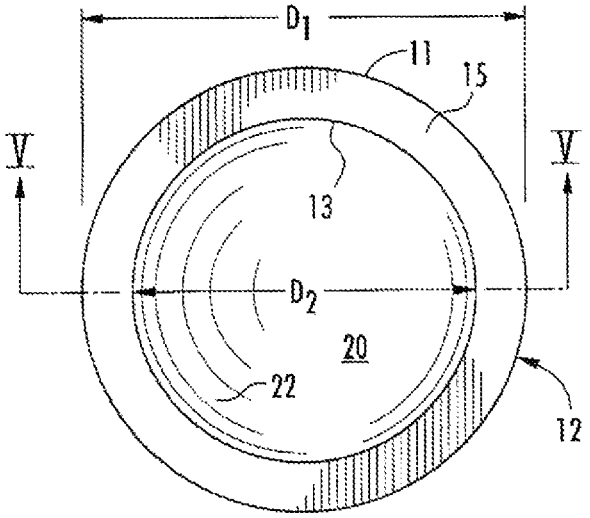
FIG. 2 is a top plan view of the crucible shown in FIG. 1.

In prior furnaces, the furnace power was approximately 7500 watts when a voltage of about 6.25 volts was supplied at a current of 1200 amps. With the present crucible 10, at the same 6.25 volts, only 800 amps of current is required, providing a power of 5000 watts to achieve the same about 3000° C. fusion temperature within the crucible 10. This is a power savings of approximately 30%, which not only saves the laboratory using the furnace for analysis of specimens electricity costs, it also allows the manufacture of the furnace to employ less expensive components since a lower current power supply is required. The following dimensions identified below and shown in FIGS. 2, 3, and 5 provided optimized performance for the preferred embodiment of the invention. Although these dimensions were optimized for the crucible, they may be varied somewhat. The depth, diverging angle, and radius of curvature of indentation 16, however, is of great importance.

The diameter $D_3$ (FIG. 3) of the indentation 24 in the pedestal was about 0.19 inches, with a depth $H_2$ (FIG. 5) of about 0.056 inches. The overall crucible height $H_1$ (FIG. 5) is 1.1 inches, while the height of pedestal base 14 $H_3$ (FIG. 5) was about 0.060 inches. The distance $H_4$ between the upper edge of the pedestal and the lower edge of the outer cylindrical body 12 of the crucible (i.e., the open mouth of the arcuate indentation 16) was about 0.224 inches. The radius of curvature $R_1$ of floor 20 was 0.35 inches while the junction of the floor 20 to the side wall 13 has a radius of curvature $R_2$ of 0.060 inches. The indentation 16 has diverging upper and lower side walls 26, 28 at an angle $\alpha$ of from about 56° to about 60°, and preferably about 58°. The angle $\beta$ from the lower wall 28 to the bottom surface 32 is from 22°-24°. The radius of curvature $R_3$ of the smoothly curved annular indentation 16 is about 0.050 inches. The depth $L_1$ (FIG. 5) of indentation 16 is about 0.166 inches. The outer diameter $D_1$ (FIG. 2) of the crucible was 0.50 inches while the inner diameter $D_2$ was 0.39 inches, leaving a wall thickness of 0.055 inches.

It is expected that the specific dimensions given can vary within the normal manufacturing tolerances of machining of such crucibles and may be varied as much as up to 3%, although it was discovered that the smoothly curved annular indentation 16 dimensions and geometry are critical to the successful functioning of the crucible to provide the unexpected uniform heating as well as lower power consumption. The crucible is subjected to approximately 83 pounds force when positioned between the upper and lower electrodes, as disclosed in the above-identified copending application, with the lower electrode having an upwardly projecting tip which extends within a circular indentation 24 in the pedestal 14 but does not touch the floor 25 of the indentation in the pedestal. Thus, the contact between the crucible 10 with the lower electrodes of the furnace is only the annular surface of the lower electrode tip and the annular lower surface 32 of the pedestal base 14. The maximum resistance area at the lower part of crucible 10 is the current choke area identified by arrow C in FIG. 5 and results in the uniform heating of the floor 20 of the crucible and the side walls up to the area of arrow A (FIG. 5). This provides improved uniform heating of specimens introduced into the crucible and prevents the fused specimen from bubbling over the top of the crucible through opening 18 contaminating the upper electrode. The crucible height $H_1$ is slightly (10%) higher than the usual crucible construction, which also assists in the prevention of specimens reaching the upper electrode.

It will become apparent to those skilled in the art that various modifications to the preferred embodiment of the inventions as described herein can be made within the confines of the dimensions discussed above without departing from the spirit or scope of the invention as defined by the appended claims.

The invention claimed is:

1. A graphite crucible for use in a resistance analytical furnace comprising:

a generally cylindrical body having a pedestal base and an inwardly concave arcuate annular indentation having a depth of 0.166 inches extending between said body and said base having a smoothly curved radius of curvature of 0.05 inches with upper and lower walls diverging at an angle of from 56° to 60° and wherein said cylindrical body has a cylindrical inner side wall, and said concave floor of said crucible has corners between said inner side wall and said concave floor having a radius of curvature of 0.06 inches; and wherein said pedestal base is generally disk-shaped, wherein said disk-shaped base has a bottom surface which includes a centrally formed circular indentation with a diameter of 0.19 inches and a depth of 0.056 inches, and wherein said cylindrical body has a concave floor having a radius of curvature of 0.35 inches; and said base has a bottom surface, and said lower wall and said bottom of said base form an angle of from 22°-24°.

2. The crucible as defined in claim 1 wherein the outer diameter of said crucible body is 0.5 inches and the inner diameter of said crucible body is 0.4 inches.

3. The crucible as defined in claim 1 wherein the overall height of said crucible is 1.1 inches.

4. The crucible as defined in claim 1 wherein said pedestal base has a height of 0.06 inches.

* * * * *